US007495556B2

(12) United States Patent
Eubelen et al.

(10) Patent No.: US 7,495,556 B2
(45) Date of Patent: Feb. 24, 2009

(54) SENSOR FOR USE WITH AUTOMATIC DOORS

(75) Inventors: Emmanuel Eubelen, Dalhem (BE); Stephane Bronsard, Heure-le-Romain (BE); Thierry Jongen, Boncelles (BE)

(73) Assignee: B.E.A. s.a., Angleur (BE)

( * ) Notice: Subject to any disclaimer, the term of this patent is extended or adjusted under 35 U.S.C. 154(b) by 219 days.

(21) Appl. No.: 11/335,979

(22) Filed: Jan. 19, 2006

(65) Prior Publication Data

US 2006/0187037 A1 Aug. 24, 2006

(30) Foreign Application Priority Data

Jan. 21, 2005 (EP) ..... 05001255

(51) Int. Cl.
*G08B 13/18* (2006.01)

(52) U.S. Cl. ..... 340/552; 340/545.1; 340/545.2; 340/545.3; 340/565

(58) Field of Classification Search ..... 340/551, 340/441, 552, 545.1, 545.2, 545.3, 541, 545.9, 340/565, 567; 49/26, 28; 318/364
See application file for complete search history.

(56) References Cited

U.S. PATENT DOCUMENTS

| | | | | |
|---|---|---|---|---|
| 4,565,029 | A * | 1/1986 | Kornbrekke et al. | 49/25 |
| 4,967,083 | A * | 10/1990 | Kornbrekke et al. | 250/341.7 |
| 5,142,152 | A * | 8/1992 | Boiucaner | 250/341.7 |
| 5,225,689 | A | 7/1993 | Buckle et al. | |
| 5,410,149 | A * | 4/1995 | Winston, Jr. et al. | 250/221 |
| 6,114,956 | A | 9/2000 | Van Genechten | |
| 6,678,999 | B2 * | 1/2004 | Zengguang et al. | 49/25 |
| 6,700,542 | B2 | 3/2004 | Borlez et al. | |
| 6,782,660 | B2 * | 8/2004 | Takada et al. | 49/25 |
| 6,970,085 | B2 * | 11/2005 | Okabe et al. | 340/545.6 |
| 7,045,764 | B2 * | 5/2006 | Beggs et al. | 250/221 |
| 7,064,666 | B2 * | 6/2006 | Sasaki et al. | 340/545.3 |
| 7,129,892 | B2 | 10/2006 | Borlez et al. | |
| 7,154,112 | B2 | 12/2006 | Eubelen | |
| 2003/0122514 | A1 * | 7/2003 | Mercier et al. | 318/280 |
| 2006/0087430 | A1 | 4/2006 | Zambon | |
| 2006/0162254 | A1 * | 7/2006 | Imai et al. | 49/26 |
| 2006/0169876 | A1 | 8/2006 | Zambon | |
| 2006/0192141 | A1 | 8/2006 | Koops | |

FOREIGN PATENT DOCUMENTS

| | | |
|---|---|---|
| EP | 0367402 A1 | 5/1990 |
| EP | ISR 05 00 1255 | 5/2005 |

* cited by examiner

*Primary Examiner*—Toan N Pham
(74) *Attorney, Agent, or Firm*—Woodling, Krost and Rust

(57) ABSTRACT

The present invention relates to a sensor (8) for use with an automatic door comprising at least two detectors (10, 12) based on different technologies, a processor (14) for processing the signals generated by at least two detectors (10, 12) in that it simultaneously uses the signals in order to combine the signals and to accurately detect the situation in a surveillance area (20, 22) sensed by the sensor (8).

13 Claims, 2 Drawing Sheets

SENSOR FOR USE WITH AUTOMATIC DOORS

Figure 1:
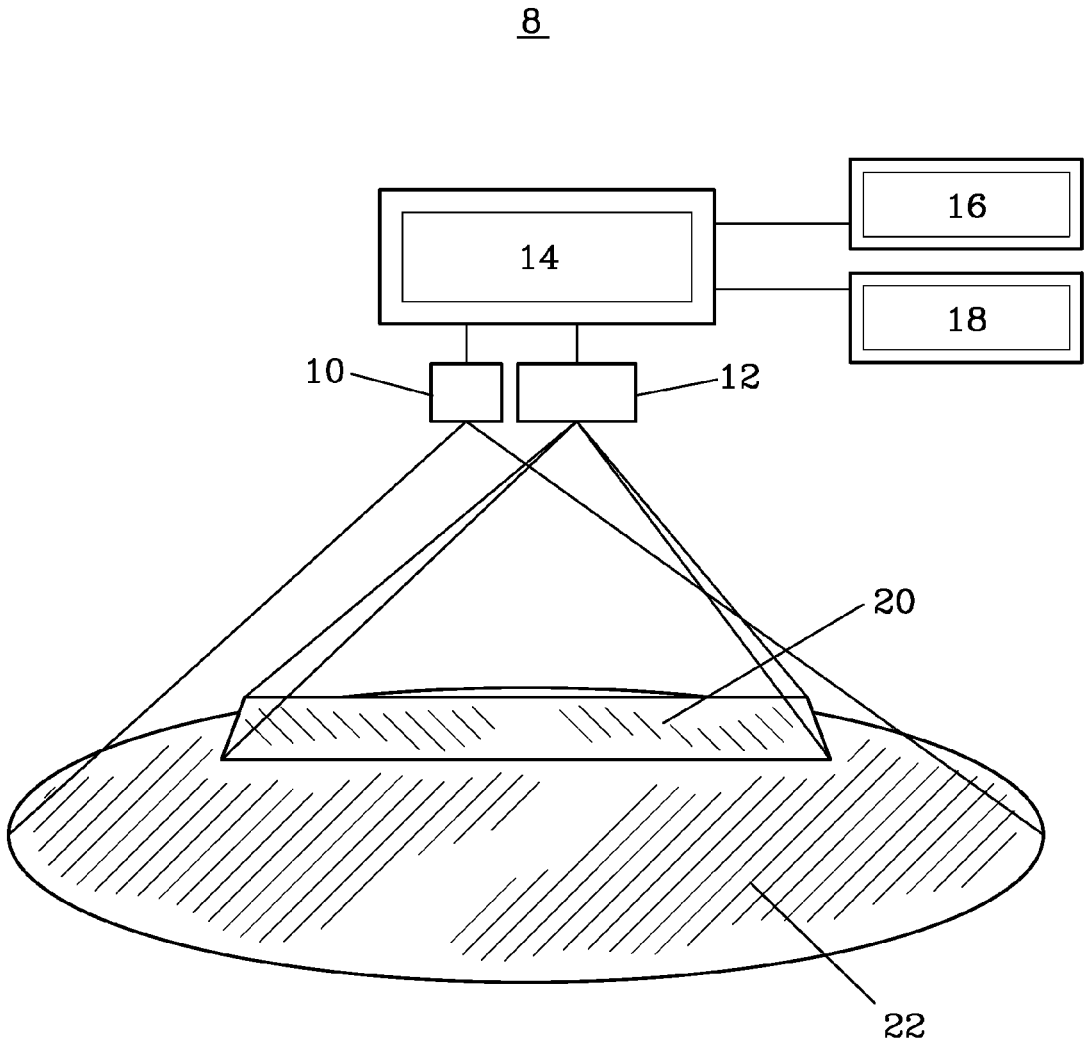

The present invention relates to a sensor for use with automatic doors according to claim 1 and a method for controlling an automatic door according to claim 11.

In most of the sensors used with automatic doors, a single technology is applied to sense the environment and detect presence or motion around doors. These sensors generate only a single output signal which corresponds to the detection status of the sensor. Multiple technology sensors are also known from the state of the art. They use several detection technologies in the same casing and, for each of them, the detector has a separate output such as an electromechanical relay, a transistor, any electronic or electromechanical switching device or even a bus connection where the output status are sent by bits in the data stream. The sensing or detection zone of such sensors is usually covered by a set of detection zones such as infrared spots or microwave radiation pattern in order to detect motion or presence over a wide area around a door and to reliably open or close the door. So far, the information coming from the different sensing heads is processed in a separate way and controls separate outputs. This approach does not make any use of the added information available from the combined analysis of all the sensors signals at the same time.

In US 2003/0122514 is disclosed a method of and an apparatus for operating a door, which is controlled by an automatic control system. The automatic control system comprises a sensor and a door controller connected with the sensor. The sensor is provided with a microwave detector—motion detector—, an IR detector—presence detector and a microcontroller/processor connected to these detectors. The door controller receives two separate signals from the microcontroller/processor of the sensor, namely one signal with respect to the microwave controller—motion signal—and one signal with respect to the IR controller—presence signal.

The opening and closing of said door is effected in response to said motion detection signal, representing motion or absence of motion in a predetermined area as detected by at least one motion detector. The opening or maintaining said door in the open position is effected in response to said presence detection signal representing presence in said predetermined area.

In this embodiment both detection functions—microwave and IR—are clearly separately. The two processes even done by the same processor are in fact independent. No situation of the one detector with the one signal has an influence on the second detector with the second signal. This leads in the sensor to two separates outputs of the sensor. However subsequent the sensor said door controller is provided to manage the two signals, namely to override said motion detection signal by said presence detection signal to maintain said door in the open position. It is a logic combination of the sensor output.

According to this known embodiment the resolution of the situation in front of the door is very general and thus imprecise. The construction and method results long holding times for the user and malfunction of the opening, closing or maintaining open of the door.

EP-A-0 367 402 discloses the use of two detectors to detect in the same area the motions of persons. This dual technology sensor ensure more reliable detection. Furthermore, the detection on the one detector—PIR—triggers the power supply of the other detector—microwave detector. Thereby, the power consumption can be reduced.

U.S. Pat. No. 6,114,956 discloses a microwave sensor using a special linear antenna in the form of a waveguide, which is supposed to be mounted along the door width. The waveguide linear approach has an inherent property of parallel traffic rejection that is not complemented by an infrared curtain simultaneously. This kind of waveguide linear antenna is very expensive. Furthermore, this sensor, by its property of parallel traffic rejection, would reject movement very close to the door, that appear as being parallel of course but that could be made by persons desiring to enter anyway.

It is an object of the invention to provide a sensor for use with automatic doors in order to further improve the detection of motion and presence in a surveillance area of an automatic door with a higher resolution.

These and other objects of the present invention are accomplished generally by a sensor for use with automatic doors comprising the features of claim 1 and a method for controlling an automatic door according to claim 11.

Preferred embodiments of the invention are defined in the dependent claims.

An essential aspect of the invention is the usage of two different sensing technologies in the same sensor, wherein the status of the one detector influence the other sensor at the same time by using the processor of the sensor to improve the detection. Preferably, a microwave detector is applied to detect motion around doors and an infrared curtain detector is used to provide motion or presence detection within a curtain covering the door threshold. Such a sensor provides two corresponding separate outputs that are driven by a processor of the sensor, e.g. a micro-controller adapted for usage within automatic door applications. Since all sensing functions are processed by the same micro-controller, this device receives all of the information from all detectors. According to this, it is not only able to process the information separately, but also to take benefit of the simultaneous analysis of all detector signals in order to combine them in an intelligent way, for example in order to provide additional functionalities.

Thus, the invention relates to a sensor for use with an automatic door comprising at least two detectors based on different technologies, a processor for processing the signals generated by the at least two detectors in that it simultaneously uses the signals in order to combine the signals and to accurately detect the situation in a surveillance area sensed by the sensor.

This sensor can comprise a plurality of outputs which can be activated by different combinations of the signals generated by the at least two detectors. This means that the outputs are controlled by an intelligent combination of detector signals, and not only by a single detector signal.

Preferably, the sensor comprises two detectors and two outputs which can be triggered by a combination of information from the signals generated by the two detectors wherein the combination of information differs for the two outputs. This means that each output is controlled by a different combination of information which is received by the processor.

In a preferred embodiment of the invention, one of the detectors is a microwave detector for motion detection and another one of the detectors is an infrared curtain detector for motion or presence detection.

According to one aspect of the invention, the processor can be adapted to generate a single output signal based on a combination of the signals generated by the microwave detector and the infrared curtain detector wherein the processor processes the combination by activating a presence detection of the infrared curtain detector only if the motion detection of the microwave detector has triggered a motion in its detection area.

The processor is preferably adapted to shut off the infrared curtain detector and to process only the signal generated by the microwave detector if no presence and motion is detected in the surveillance area of both detectors.

According to a second, alternative aspect of the invention, one of the detectors can be a microwave detector for quasi-presence detection and another one of the detectors can be an infrared curtain detector for motion detection.

Preferably, the processor is then adapted to generate a single output signal based on a combination of the signals generated by the microwave detector and the infrared curtain detector wherein the processor processes the combination by activating a quasi-presence detection of the microwave detector only if the motion detection of the infrared curtain detector has triggered a motion in its surveillance area.

Furthermore, the processor can be adapted to shut off the microwave detector and to process only the signal generated by the infrared curtain detector if no presence and motion is detected in the surveillance area of both detectors.

Finally, the infrared curtain detector can be switched in a presence detection mode if a motion in its surveillance area has been detected before.

The invention relates also to a method for controlling an automatic door by detecting traffic in a detection zone before the automatic door, wherein the output signal of a microwave detector is processed by a Doppler sensing algorithm and in parallel by a special traffic rejection algorithm for detecting over a restricted set of trajectories, the output signal of an infrared curtain detector is processed by an infrared curtain detection algorithm, wherein when a pedestrian enters the detection zone with an appropriate normal trajectory, the traffic rejection algorithm validates the trajectory and the microwave detector triggers the opening of the automatic door, when the pedestrian enters the detection zone with a parallel trajectory, the parallel traffic rejection algorithm prevents the door to open unless the target trajectory is so close to the door that the wide non discriminative motion detection lobe and the infrared curtain lobe are detecting simultaneously and the processor triggers the opening of the door.

Preferably, the infrared curtain lobe is set to motion detection when the door is closed and set to presence detection when detection has occurred.

Further advantages and possible applications of the present invention become apparent from the following detailed description with reference to the exemplifying embodiments illustrated by way of example in the drawings.

Figure 2:
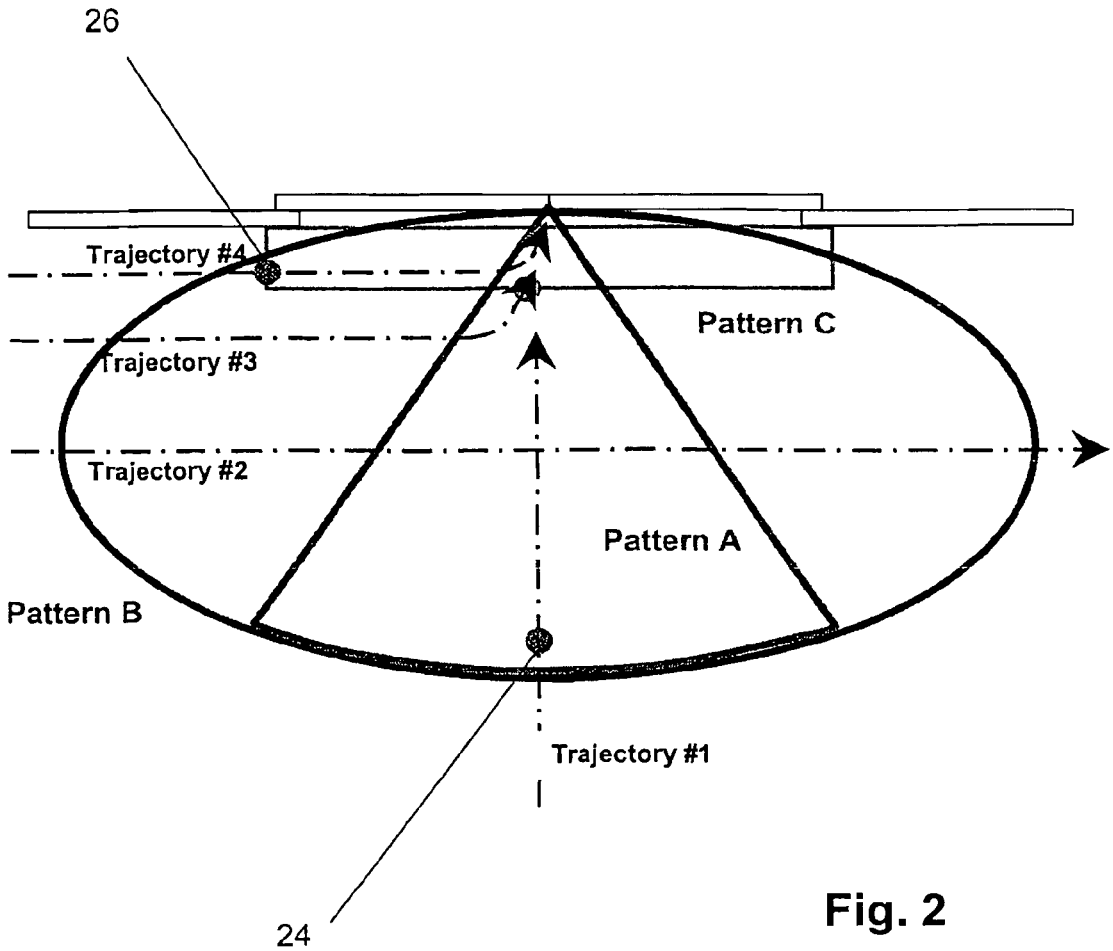

In the description, the appended claims, the abstract and the drawings, use is made of the terms and corresponding reference numerals summarised in the list provided at the end of the description. In the drawings is shown:

FIG. 1 a schematic view of an embodiment of a sensor for automatic doors comprising a microwave detector and an infrared curtain detector according to the invention; and FIG. 2 a schematic view of different trajectories and detection patterns of the sensor according to the invention.

The sensor 8 for automatic doors as shown in FIG. 1 uses two different sensing devices for operation. The first one is a microwave detector 10, well known in the state of the art to be very effective in detecting movement in a quite large surveillance area 22 depending on the radiation pattern. The second one is an infrared (IR) based curtain ensuring motion or presence detection by an infrared curtain detector 12 close to the door threshold (surveillance area 20). Also, alternative technologies which allow similar kinds of detection patterns could be used.

The availability of several complementary technologies has several advantages over the current state of the art. It is possible by combining their information to make a smarter sensor 8. When targets like pedestrians are walking through the automatic door, the detectors 10 and 12 will detect this according to a predictable sequence. In the embodiment of FIG. 1, the microwave motion detection will occur first, followed by the IR presence detection when the target reaches the door threshold. Both detectors 10 and 12 have different detection properties and surveillance or detection areas 20 and 22, respectively, that make the overall information received by a micro-controller 14 of the sensor 8 richer. The sensor 8 is provided with a first output 11 and a second output 18 for an automatic door—not shown.

This is also valid for sensors 8 which use different technologies than microwave and active IR to provide the detection functions. The sensor 8 can also comprise more than two detectors.

Some automatic doors have only one input. In this case the common state of the art approach is to combine the two output signals of the sensor 8 in parallel and to connect them to the single door opening input. In this case, any triggering of the IR curtain occurring without motion detection is most likely to be due to a parasitic ground reflection variation (under rain or snow conditions, for example). A better way of combining these signals can improve this.

As the signals of both detectors 10 and 12 are fed into the micro-controller 14, it is possible to trigger the IR presence detection only when there has been some movements detected by the microwave detector 10. For a single output detector, this approach has the advantage of preventing the sensor 8 from detecting undesired ground variations if nobody has entered the motion detection field (surveillance area 22) first.

Due to climatic conditions according to rain, snow, wind pushing leaves in the sensing area, the IR detector 12 could detect this variation and trigger the opening of the door. Typical door operators have two inputs, one for the safety, the second one for motion detection. But when only one input is available, it is desirable to include this function inside the algorithm of the sensor 8 which is processed by the micro-controller 14 (processor). As the processor 14 has all the knowledge of the situation from both IR and microwave detectors 10 and 12, it is able to make a correct decision in order to open the door. This results in a door system with an improved immunity against false opening over a wide range of climatic conditions.

Inside the sensor 8, the micro-controller 14 will then only take care of the information from the IR detector 12 when there has been initially a motion detection triggering the output relay to open the door. In this particular case, it is clear that only one single relay is needed. The second one is not necessary. When the movement of a target is detected by the motion detector of the sensor 8, i.e. the microwave detector 10, the IR detector 12 is automatically enabled and will detect even non-moving targets within the door threshold. When the target leaves the door area, both detections end, the sensor 8 is put back into idle mode, where only the microwave detector 10 and thus microwave detection is enabled. Any false detection on the IR detector 12 is ignored.

For specific applications, it is advantageous to have a sensor 8 that is able to provide the following: have a detection field very close to the door to be used in heavy density sidewalk situations (surveillance area 20). This small detection lobe can then be used to prevent false triggering from people walking along the sidewalk without any intention to enter the door. When someone approaches the hand close to the door, the IR curtain detector 12 detects the hand and opens the door. At this point, it becomes desirable to have a larger detection field to keep the door open in case of someone following the first person, who triggers the door, wants to enter, too. The sensor 8 can then be configured to provide movement detection on the IR curtain 20, and quasi-presence on the microwave detector 12 by activating a high sensitivity slow movement detection mode.

If the door operator has two inputs, the infrared curtain detector 12 output signal will then be connected to the motion detection input of the door and the microwave detector 10 will be connected to the safety detection input of the door. In case the door operator has only one input, a logical combination of the IR detector 12 and the microwave detector 10 will be generated by the processor 14 to open the door IR and take care of microwave only when the door is open.

The presence detection in IR mode can also be switched to simple movement detection by modification of the algorithms in such a way to detect only variations of ground reflectivity instead of an absolute value. If so, the immunity of the sensor 8 to ground variations will be reinforced.

If a higher level of safety is desirable around the door, the IR detector 12 of the sensor 8 will be kept in presence detection mode and it will keep the door open when there is a non-moving target inside the door threshold.

Advanced signal processing techniques applied to the microwave detector 10 are capable of improving the detection of a target according to his/her initial angle of arrival relative to the door. It is possible to make the sensor 8 almost insensitive to the parallel traffic of pedestrians in front of the door. More specifically, the detection can be programmed to be only active when a target approaches the door within a restricted angle of arrival centred on the axis of the door (see FIG. 2 which shows different trajectories and detection patterns of the sensor 8 according to the invention).

When a target approaches the door on a parallel trajectory and suddenly decides to enter the door, the sensor 8 needs some distance to evaluate the trajectory. When the parallel trajectory is far enough from the door, there should be no problem to open it. But if the pedestrian is too close to the door during her/his parallel trajectory and decides to enter the door when reaching the centre, the microwave detector 10 may not be capable of detecting the direction change.

To overcome this problem, the invention suggests the following approach: the microwave detector 10 can use a Doppler signal in two ways: process the parallel traffic rejection algorithm to obtain the pattern A. Use simultaneously the normal Doppler detection algorithm to obtain detection pattern B. The IR detector 12 is covering pattern C. The sensor 8 can be programmed to behave as follows:

Trajectory #1: when a pedestrian moves towards the door in the A pattern, the parallel traffic rejection algorithm validates the trajectory and the pedestrian is detected very early to increase comfort at detection point 24.

Trajectory #2: when a pedestrian moves parallel to the door and not too close to it, the parallel traffic rejection algorithm rejects the target and the door stays closed no detection point.

Trajectory #3: when the pedestrian moves parallel to the door and relatively closer to it, the IR detection ensures the detection in case of abrupt change of direction. When reaching the surveillance area 20 of the IR detector 12, it will be simultaneously detected by the normal microwave pattern B and the IR detection pattern C. In this case the door will also be triggered to open.

Trajectory #4: when a pedestrian moves parallel to the door and very close to it, it will also be detected by the microwave normal Doppler sensing pattern B and IR detection pattern C earlier to increase comfort—see detection point 26. In fact, in this case, the pedestrian is so close to the door that it is really supposed to be willing to enter.

REFERENCE NUMERALS LIST

10 Microwave detector
12 Infrared curtain detector (IR detector)
14 Microcontroller
16 First output
18 Second output
20 Surveillance area of the IR detector
22 Surveillance area of the microwave detector
24 Detection point of trajectory 1
26 Detection point of trajectory 3

The invention claimed is:

1. Method for controlling an automatic door by detecting traffic in a detection zone before the automatic door, wherein an output signal of a microwave detector is processed by a Doppler sensing algorithm and in parallel by a traffic rejection algorithm for detecting over a restricted set of trajectories, an output signal of infrared detector is processed by an infrared detection algorithm, wherein when a pedestrian enters said detection zone with an appropriate normal trajectory, said traffic rejection algorithm validates the trajectory and said microwave detector triggers opening of said automatic door, when a pedestrian enters said detection zone with a parallel trajectory, the parallel traffic rejection algorithm prevents said door from opening unless the target trajectory is so close to said door that a wide non-discriminative motion detector lobe of said microwave detector and an infrared lobe of said infrared detector are detecting simultaneously and the processor triggers opening of said door.

2. Method according to claim 1, wherein said infrared lobe of said infrared detector is set to movement detection when said door is closed and set to presence detection when detection has occured.

3. Sensor (8) for use with an automatic door comprising: at least two detectors (10, 12); one of said at least two detectors is a microwave detector (10) and said other of said at least two detectors is an infrared detector (12); each of said detectors generate signals; a processor (14), said processor processes said signals generated by said at least two detectors; said processor simultaneously and continuously uses information from both signals of said detectors (10, 12) to dynamically optimize overall detecting performance in surveillance areas (20, 22); and, a plurality of outputs (16, 18) activated by different combinations of said signals generated by said at least two detectors (10, 12).

4. Sensor according to claim 3, wherein each said output is a diffenent combination of said signals, said signals include any or all of motion detection, presence detection and quasi-presence detection.

5. Sensor according to claim 3, wherein said microwave detector (10) is for motion detection and said infrared detector (12) is for presence or motion detection; said processor (14) is adapted to generate a single output signal based on a combination of said signals generated by said microwave detector (10) and said infrared detector (12) and said processor (14) activates said presence or motion detection of said infrared detector (12) upon activation of said microwave detector (10).

6. Sensor according to claim 3, wherein said infrared detector is near a field detector and said microwave detector is a far field motion detector (10); said microwave detector capable of detecting even very slow movements providing quasi-presence detection; said infrared curtain detector is activated over a short distance, activating the opening of the door and said microwave detector is activated over a greater distance than said infrared detector, ensuring that the said door remains open if movement is detected.

7. Sensor according to claim 3, wherein said processor (14) is adapted to generate a single output signal based on a combination of said signals generated by said microwave detector (10) and said infrared detector (12); said processor (14) activating quasi-presence detection of said microwave detector (10) upon activation of said infrared detector (12).

8. Sensor according to claim 3, wherein said microwave detector (10) is for motion detection and said infrared curtain detector (12) is for presence detection.

9. Sensor according to claim 3, wherein said microwave detector (10) detects very slow movements assimilated to a quasi presence detection of human beings and said infrared detector (12) detects motion.

10. Sensor (8) for use with an automatic door comprising:

an infrared near field curtain detector and a microwave far field motion detector (10), said microwave detector capable of detecting even very slow movements providing quasi-presence detection; said infrared detector is activated over a short distance, activating the opening of said door and said microwave detector is activated over a greater distance ensuring that said door remains open if movement is detected; each of said detectors generates signals;

a processor (14); said processor processes said signals generated by said at least two detectors, said processor simultaneously uses information from both signals of said detectors (10, 12) to optimize overall detecting performance in surveillance area (20, 22) sensed by sensor (8), said processor (14) is adapted to generate a single output signal based on a combination of said signals generated by said microwave detector (10) and said infrared curtain detector (12); said processor (14) activating quasi-presence detection of said microwave detector (10) upon activation of said infrared detector (12); and said processor (14) is adapted to shut off said microwave detector (10) and process only said signal generated by said infrared detector (12) if no presence and motion is detected in both surveillance areas (20, 22).

11. Sensor according to claim 10, wherein said infrared curtain detector (12) can be switched to a presence detection mode if motion has been detected in its surveillance area (20).

12. Sensor (8) for use with an automatic door comprising: at least two detectors (10, 12), one of said at least two detectors is a microwave detector (10) and said other of said at least two detectors is an infrared detector (12); each of said detectors generates signals; a processor (14); said processor processes said signals generated by said at least two detectors; said processor simultaneously uses information from both signals of said detectors (10, 12) to optimize overall detecting performance in surveillance areas of (20, 22); a plurality of outputs (16, 18) activated by different combinations of said signals generated by said at least two detectors (10, 12); said microwave detector (10) is for motion detection and said infrared curtain detector (12) is for presence detection; said processor (14) is adapted to generate a single output signal based on a combination of said signals generated by said microwave detector (10) and said infrared detector (12) and said processor (14) activates said presence detection of said infrared detector (12) upon activation of said microwave detector (10); and, said processor (14) is adapted to shut off said infrared curtain detector (12) and process only said signal generated by said microwave detector (10) if no presence and motion is detected in both surveillance areas (20, 22).

13. Sensor (8) for use with an automatic door comprising: at least two detectors (10, 12); one of said at least two detectors is a microwave detector (10) and said other of said at least two detectors is an infrared detector (12); each of said detectors generates signals; a processor (14); said processor processes said signals generated by said at least two detectors; said processor simultaneously uses information from both signals of said detectors (10, 12) to optimize overall detecting performance in surveillance areas (20, 22); a plurality of outputs (16, 18) activated by different combinations of said signals generated by said at least two detectors (10, 12); said infrared detector (12) is a near field detector and said microwave detector (10) is a far field motion detector; said microwave detector (10) capable of detecting even very slow movements providing quasi-presence detection; said infrared detector (12) activated over a short distance and opening said door; said microwave detector (10) activated over a greater distance than said infrared detector ensuring that said door remains open if movement is detected; said processor (14) adapted to generate a single output signal based on a combination of said signals generated by said microwave detector (10) and said infrared detector (12); said processor (14) activating quasi presence detection of said microwave detector (10) upon activation of said infrared detector (12); and, said infrared detector (12) switchable to a presence detection mode if motion has been detected in surveillance area (20).

* * * * *

UNITED STATES PATENT AND TRADEMARK OFFICE

CERTIFICATE OF CORRECTION

PATENT NO. : 7,495,556 B2
APPLICATION NO. : 11/335979
DATED : February 24, 2009
INVENTOR(S) : Eubelen et al.

It is certified that error appears in the above-identified patent and that said Letters Patent is hereby corrected as shown below:

Claim 1, col. 6, line 30, after “motion” delete “detector” insert --detection--.

Claim 2, col. 6, line 36, after “has” delete “occured” and insert --occurred--.

Claim 3, col. 6, line 41, after “(14)” delete “,” and insert --;--.

Claim 4, col. 6, line 50, after “a” delete “diffenent” and insert --different--.

Claim 6, col. 6, line 63, after “near” delete “a”.

Claim 6, col. 6, line 63, after “is” insert --a--.

Claim 6, col. 6, line 66, after “infrared” delete “curtain”.

Claim 6, col. 7, line 2, after “that” delete “the”.

Claim 8, col. 7, line 11, after “infrared” delete “curtain”.

Claim 10, col. 7, line 35, after “infrared” delete “curtain”.

Claim 11, col. 7, line 35, after “infrared” delete “curtain”.

Claim 12, col. 8, line 7, after “areas” delete “of”.

Claim 12, col. 8, line 11, after “infrared” delete “curtain”.

Claim 12, col. 8, line 18, after “infrared” delete “curtain”.

Claim 13, col. 8, line 34, after “(10)” delete “capable of”.

UNITED STATES PATENT AND TRADEMARK OFFICE

CERTIFICATE OF CORRECTION

PATENT NO. : 7,495,556 B2
APPLICATION NO. : 11/335979
DATED : February 24, 2009
INVENTOR(S) : Eubelen et al.

It is certified that error appears in the above-identified patent and that said Letters Patent is hereby corrected as shown below:

Claim 13, col. 8, line 46, after "in" insert --its--.

Signed and Sealed this

Seventh Day of April, 2009

JOHN DOLL
*Acting Director of the United States Patent and Trademark Office*